US008273161B2

(12) United States Patent
Sundhar

(10) Patent No.: US 8,273,161 B2
(45) Date of Patent: Sep. 25, 2012

(54) INDOOR AIR CLEANER

(76) Inventor: Shaam P Sundhar, Princeton, NJ (US)

( * ) Notice: Subject to any disclaimer, the term of this patent is extended or adjusted under 35 U.S.C. 154(b) by 870 days.

(21) Appl. No.: 12/325,077

(22) Filed: Nov. 28, 2008

(65) Prior Publication Data

US 2010/0132560 A1 Jun. 3, 2010

(51) Int. Cl.
*B03C 3/32* (2006.01)
*B03C 3/82* (2006.01)

(52) U.S. Cl. ..... 96/83; 55/DIG. 35; 96/18; 96/26; 96/62; 96/94; 96/96

(58) Field of Classification Search ..... 96/29, 39–41, 96/83, 94, 96, 18–26, 60, 62; 95/78; 55/DIG. 35
See application file for complete search history.

(56) References Cited

U.S. PATENT DOCUMENTS

| | | | | | |
|---|---|---|---|---|---|
| 1,911,851 | A | * | 5/1933 | Scholtz | 454/289 |
| 4,334,899 | A | * | 6/1982 | McConnell | 55/321 |
| 4,549,887 | A | * | 10/1985 | Joannou | 96/58 |
| 4,828,586 | A | * | 5/1989 | Joannou | 96/66 |
| 5,290,343 | A | * | 3/1994 | Morita et al. | 96/39 |
| 5,573,577 | A | * | 11/1996 | Joannou | 96/66 |
| 5,776,218 | A | * | 7/1998 | Enns | 55/495 |
| 5,792,230 | A | * | 8/1998 | Moore et al. | 55/493 |
| 5,807,425 | A | * | 9/1998 | Gibbs | 96/66 |
| 5,906,677 | A | * | 5/1999 | Dudley | 96/17 |
| 5,989,303 | A | * | 11/1999 | Hodge | 55/486 |
| 6,156,104 | A | * | 12/2000 | Jeong | 96/88 |
| 6,241,794 | B1 | * | 6/2001 | Jadran et al. | 55/490 |
| 6,699,301 | B1 | * | 3/2004 | Eisenhauer | 55/471 |
| 6,764,533 | B2 | * | 7/2004 | Lobiondo, Jr. | 96/66 |
| 7,811,346 | B1 | * | 10/2010 | Henson | 55/385.1 |
| 7,909,918 | B2 | * | 3/2011 | Bias et al. | 96/26 |
| 2006/0277879 | A1 | * | 12/2006 | Knowles | 55/497 |
| 2007/0034081 | A1 | * | 2/2007 | Kurasek | 96/44 |

FOREIGN PATENT DOCUMENTS

JP 4-363157 A * 12/1992

* cited by examiner

*Primary Examiner* — Richard L Chiesa
(74) *Attorney, Agent, or Firm* — Patwrite LLC; Mark David Torche

(57) ABSTRACT

An air vent air purifier includes a grill portion and a housing that is attached to the bottom of the grill portion. The housing fits within a forced air vent. The housing encloses an ionization grid, control circuitry and energy source. When energized, air flowing through the vent from the air handling device passes through the ionization grid, where it is ionized, thereby cleaning the air throughout the entire room. The grill may include a decorative element to match the décor of a room. Batteries provide the energy. A series of indicator lights indicate a power on condition and the level of the battery.

1 Claim, 5 Drawing Sheets

INDOOR AIR CLEANER

BACKGROUND OF THE INVENTION

The trend is to make homes more energy efficient in order to conserve energy as well as saving money for the owner. While this is generally desirable, it does increase the problem of indoor air pollution. Some studies have indicated that indoor air is 50 times more polluted than outdoor air. Among some of the indoor pollutants detected include cleaning product residues, smoke particles, formaldehyde, pollens, dander, molds and mildews, fungi, dust mites, etc.

While these pollutants are present in the outdoor environment, they are greatly reduced by the combined action of an abundant oxygen supply due to trees, shrubs and other oxygen producing vegetation, radiation from soil and rocks, friction between the layers of wind, ultraviolet radiation form the sun, rain and the splitting of water droplets by the action of waterfalls and lightening all of which combine to produce negative ions and ozone. Dangerous ions cling to the ozone and fall out of the atmosphere greatly decreasing the pollutant concentration. This is evident in the "clean air" feeling that people experience after a thunderstorm and around a waterfall.

Ionizing air cleaners are known in the art. The most effective units employ some sort of air moving component such as a fan to ensure that the created ozone is able to attract and neutralize the pollutants present in the room. This tends to make the units noisy and cost more to operate. Additionally, they tend to create a "clean zone" or "clean air island" around the unit that diminishes in effectiveness as a person moves away. There are units that do not utilize a fan, but these units are even more prone to creating clean zones concentrated around the unit. There is a need for an ionizing cleaner that effectively cleans an entire space that is easy to operate, does not consume an inordinate amount of power, is quiet and does not take up room space.

SUMMARY OF THE INVENTION

An air vent air purifier comprises a grill portion and a housing that is attached to the bottom of the grill portion. The housing fits within a forced air vent. The housing encloses an ionization grid, control circuitry and energy source. When energized, air flowing through the vent from the air handling device passes through the ionization grid where it is ionized, thereby cleaning the air throughout the entire room. The grill may include a decorative element to match the decor of a room. Batteries provide the energy. A series of indicator lights indicate a power on condition and the level of the battery.

Other features and advantages of the instant invention will become apparent from the following description of the invention which refers to the accompanying drawings.

DETAILED DESCRIPTION OF THE INVENTION

Figure 1:
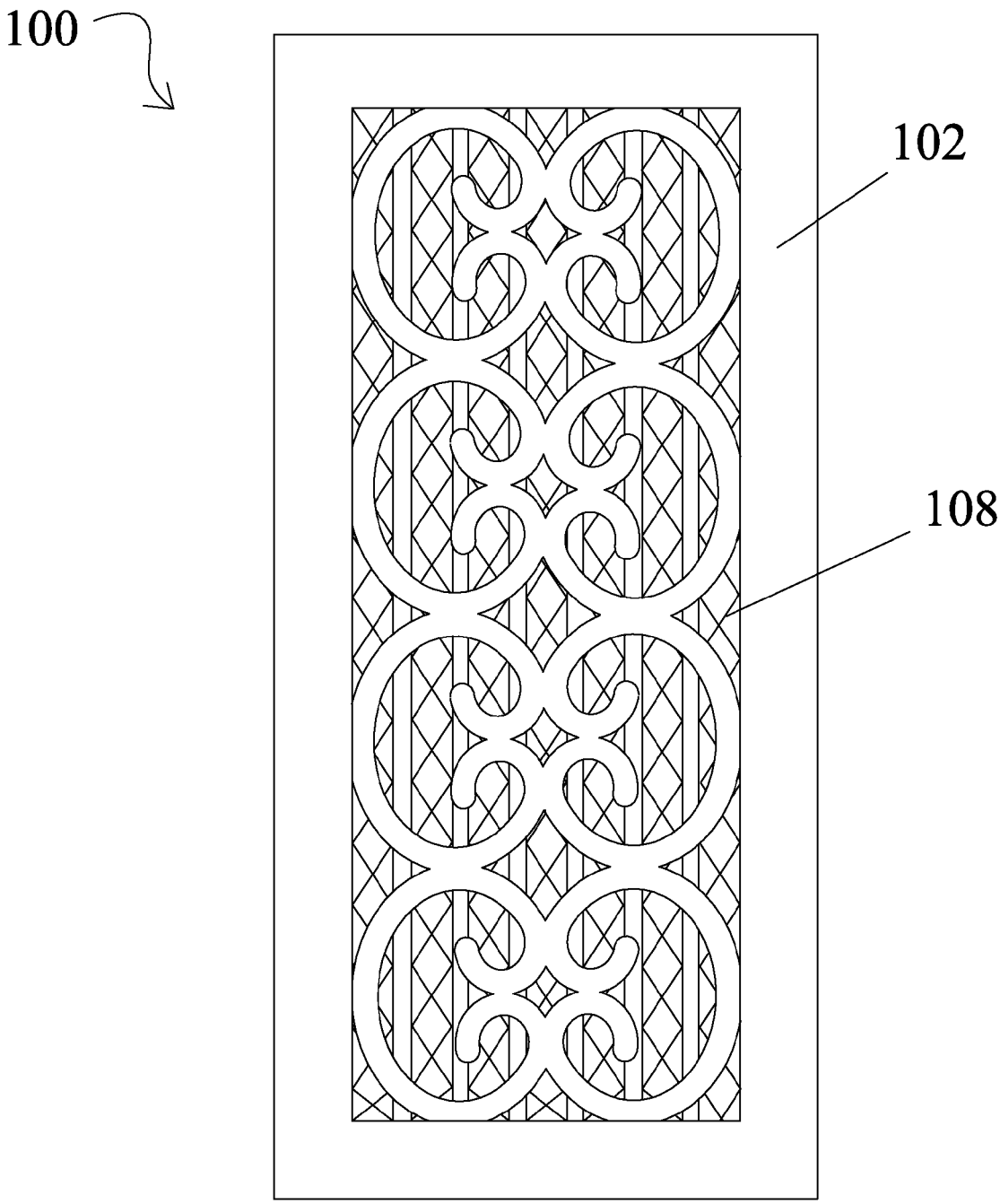
FIG. 1 is a top view of an air vent purifier according to an embodiment of the present invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIG. 1, an air vent air purifier 100 is shown having a grill portion 102 and an ionization grid 108. Grill portion 102 may be decoratively adapted to match a decor or for a sense of the aesthetic although this is not necessary for operation.

Figure 2:
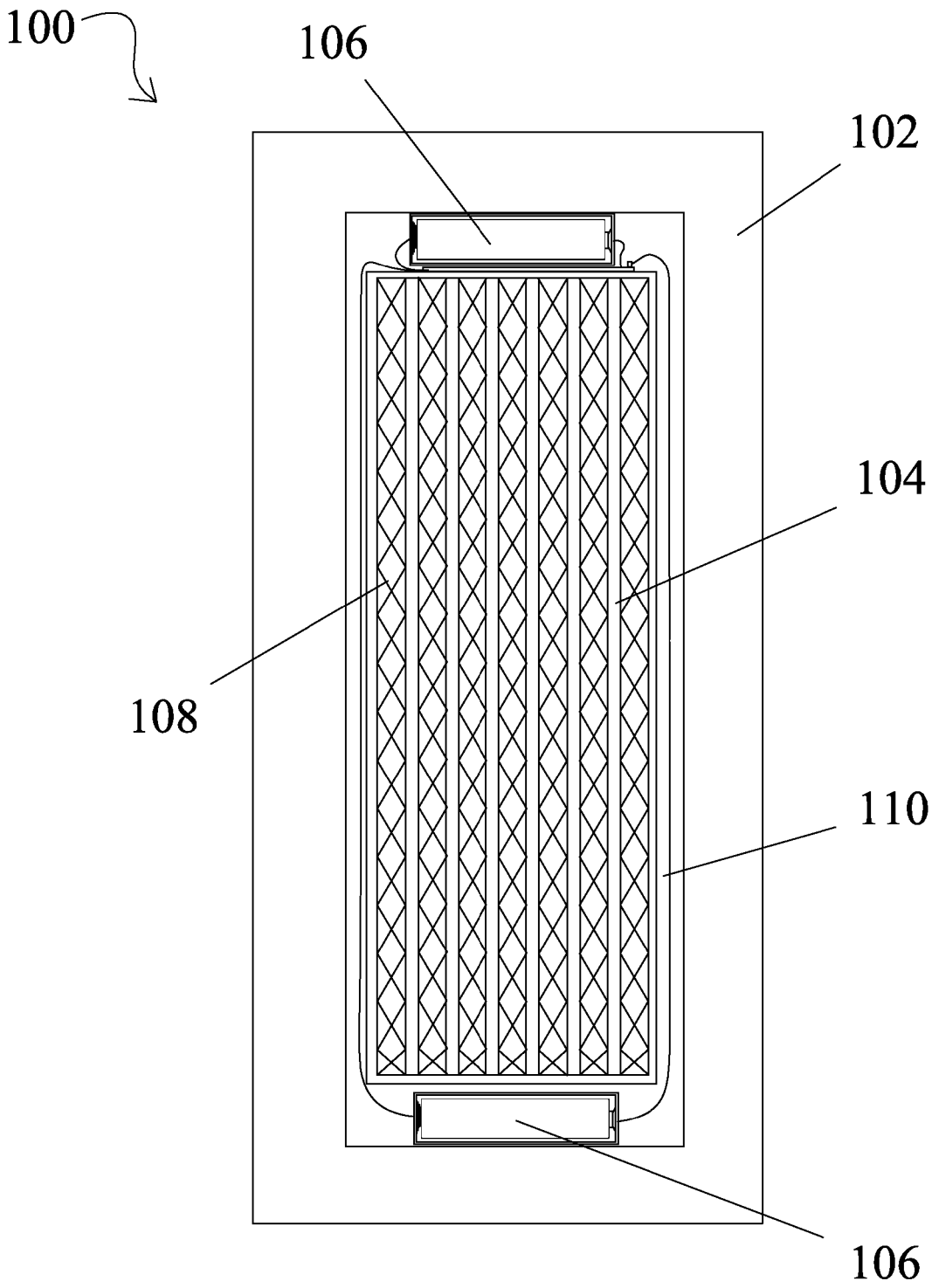
FIG. 2 is a bottom view of the air vent purifier shown in FIG. 1.
Figure 3:
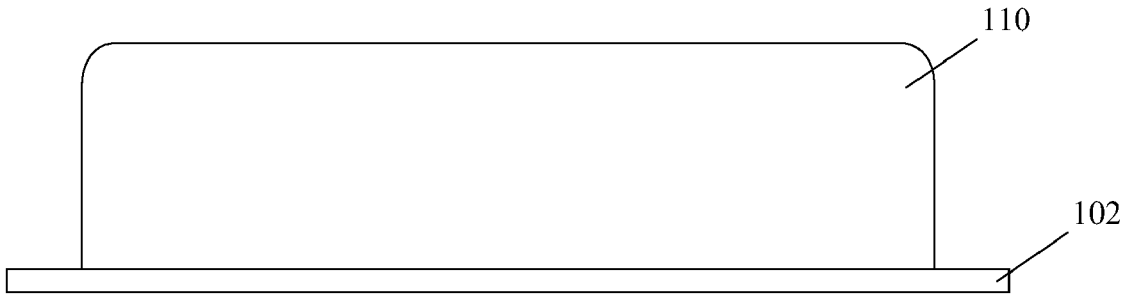
FIG. 3 is a side view of the air vent purifier shown in FIG. 1.
Figure 4:
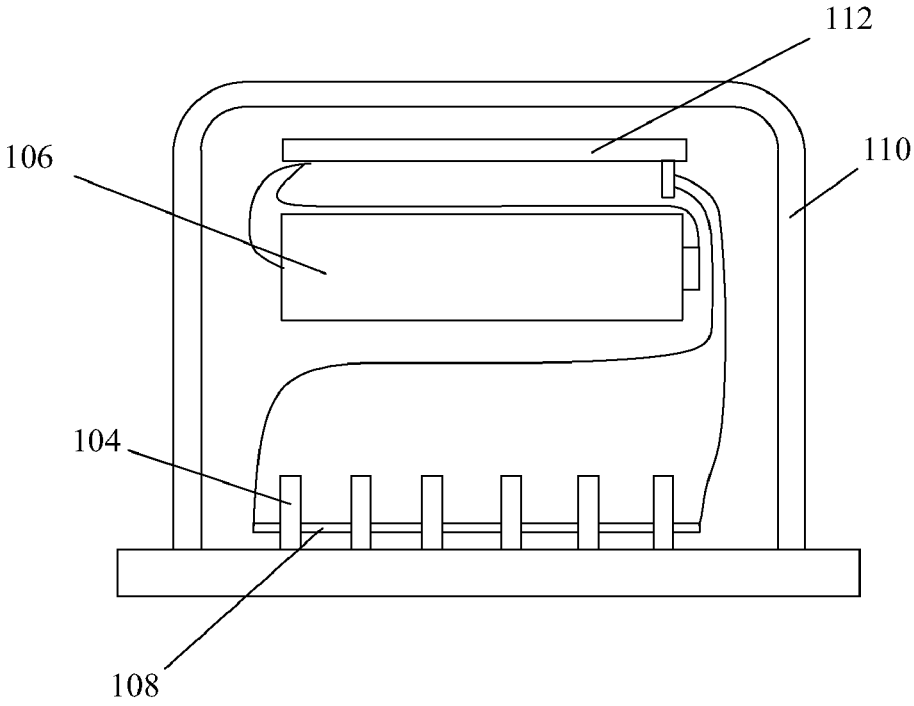
FIG. 4 is an end view of the air vent purifier shown in FIG. 1.

Now referring to FIGS. 2 through 4, a housing 110 is attached to the bottom surface of grill portion 102. Housing 110 fits within a forced air vent (not shown) in a structure or dwelling. A series of air flow fins 104 are used to direct the air flow as is known in the art. At least one battery 106 is used to provide the energy needed to energize ionization grid 108. The energy is conditioned and controlled using a control module 112 to efficiently operate air vent air purifier 100.

Housing 110, grill 102 and other components may be made of metal such as aluminum or sheet metal or they could be produced from a structurally sufficient composite or plastic material.

Figure 5:
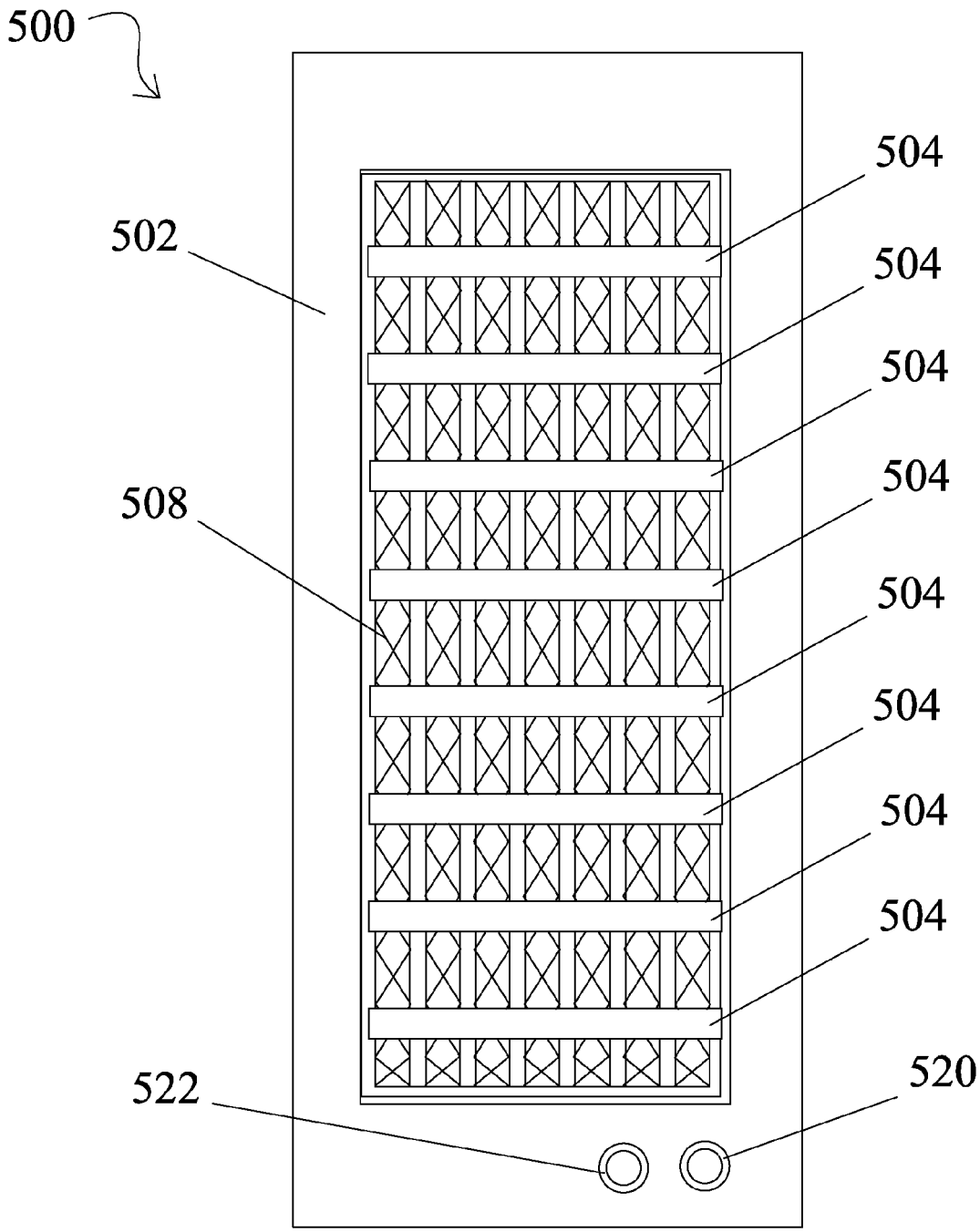
FIG. 5 is a top view of an air vent purifier according to an embodiment of the present invention.
Figure 6:
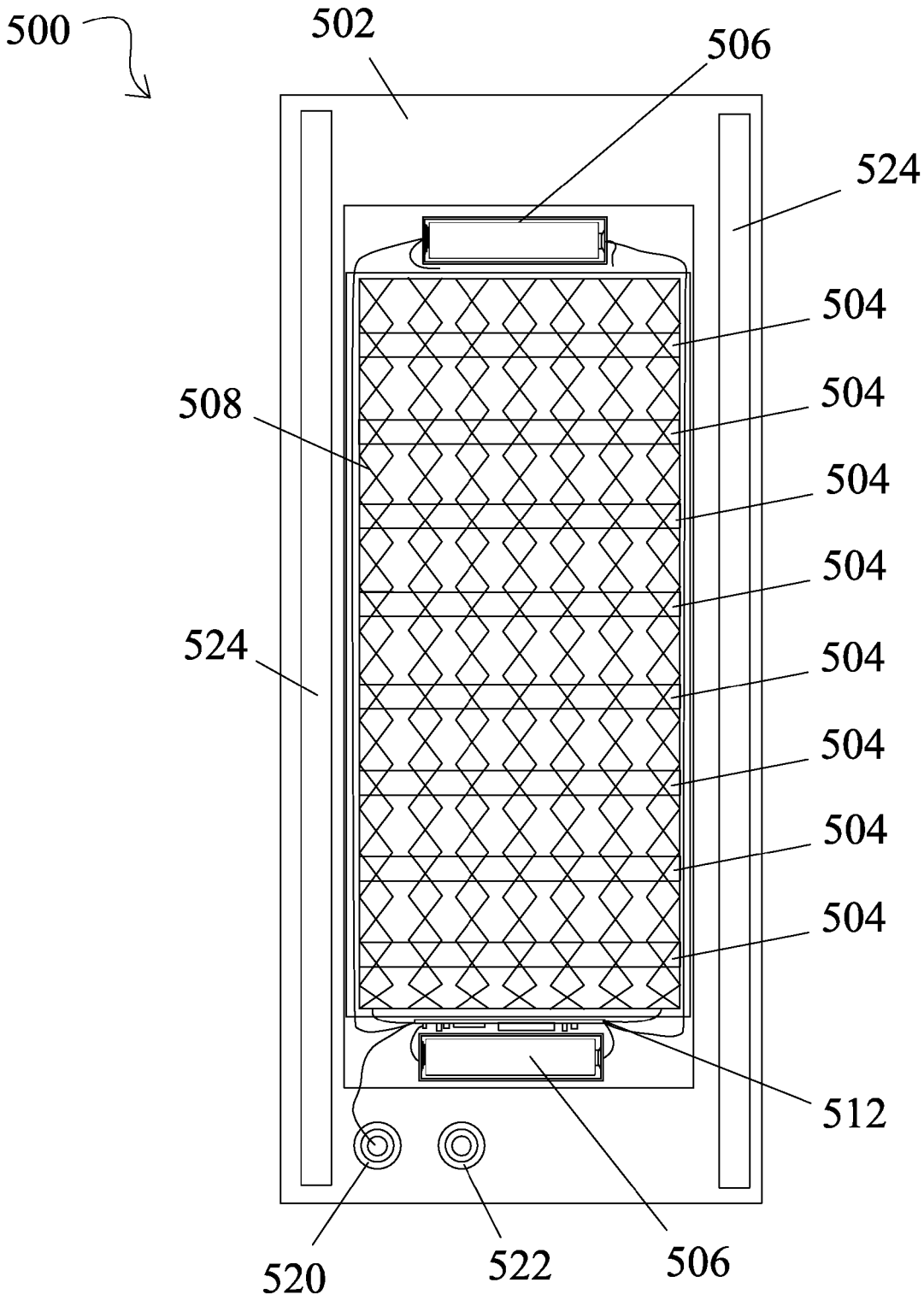
FIG. 6 is a bottom view of the air vent purifier shown in FIG. 5.

Referring now to FIGS. 5 and 6, an air vent air purifier 500 is shown having a grill portion 502, a plurality of air flow vanes 504, an ionization grid 508, energy source 506 and indicator lights 520 and 522. A first light 520 is used to indicate a power on condition to indicate that the battery is energized. A second light 522 indicates when the batteries are running low and should be replaced. A control circuit 512 controls the power requirements to activate ionization grid 508.

To hold air vent air purifier 500 to the forced air vent (not shown), a series of magnetic strips 524 along the periphery of the underside surface of grill portion 502 are provided. Other attachment means such as sticky glues or tapes, mechanically fasteners such as screws or merely friction fit within the vent are acceptably as long at air vent air purifier 500 is securely held in place.

Although the instant invention has been described in relation to particular embodiments thereof, many other variations and modifications and other uses will become apparent to those skilled in the art.

What is claimed is:

1. An air vent air purifier comprising:

a grill portion having a series of air flow fins;

a housing attached to a bottom surface of said grill portion;

said housing being adapted to fit within a selected forced air vent opening;

an ionization grid disposed within said housing; and a battery with a control module positioned within said housing for providing a voltage required to operate said ionization grid.

* * * * *